US006924825B1

(12) United States Patent
Bannai

(10) Patent No.: US 6,924,825 B1
(45) Date of Patent: Aug. 2, 2005

(54) CONTRAST ADJUSTING CIRCUIT

(75) Inventor: Masayuki Bannai, Kanagawa-ken (JP)

(73) Assignee: Fujitsu General Limited, Kawasaki (JP)

( * ) Notice: Subject to any disclaimer, the term of this patent is extended or adjusted under 35 U.S.C. 154(b) by 362 days.

(21) Appl. No.: 10/181,158

(22) PCT Filed: Aug. 8, 2000

(86) PCT No.: PCT/JP00/05316

§ 371 (c)(1),
(2), (4) Date: Jul. 12, 2002

(87) PCT Pub. No.: WO01/52228

PCT Pub. Date: Jul. 19, 2001

(30) Foreign Application Priority Data

Jan. 14, 2000 (JP) ..... 2000-005193

(51) Int. Cl.[7] ..... G09G 5/10
(52) U.S. Cl. ..... 345/690; 345/76; 345/77
(58) Field of Search ..... 345/617, 690, 345/76, 77, 89

(56) References Cited

U.S. PATENT DOCUMENTS 5,541,400 A * 7/1996 Hagiwara et al. ..... 250/208.1
5,548,325 A * 8/1996 Hashimoto et al. ..... 348/64
5,555,160 A * 9/1996 Tawara et al. ..... 362/31
5,787,414 A * 7/1998 Miike et al. ..... 707/2
6,067,164 A * 5/2000 Onoguchi et al. ..... 356/401
6,333,788 B1 * 12/2001 Yamada et al. ..... 358/1.15
6,501,545 B2 * 12/2002 Komuro et al. ..... 356/237.2
6,625,398 B1 * 9/2003 Nonaka ..... 396/121
6,754,369 B1 * 6/2004 Sazawa ..... 382/105

FOREIGN PATENT DOCUMENTS

JP 60068781 A * 4/1985 ..... H04N/5/278
JP 62193465 A * 8/1987 ..... H04N/5/57
JP 04029473 A * 1/1992 ..... H04N/5/20
JP 2003298874 A * 10/2003 ..... H04N/5/57

* cited by examiner

*Primary Examiner*—Dennis-Doon Chow
*Assistant Examiner*—Srilakshmi K. Kumar
(74) *Attorney, Agent, or Firm*—Flynn, Thiel, Boutell & Tanis, P.C.

(57) ABSTRACT

A contrast adjusting circuit used in a PDP display prevents the image from being whitish by suppressing the rise of the luminance at a low level when the contrast is heightened and optimally adjusts the contrast of the images always varying with time. The circuit contains an average luminance calculating section (12), an LUT (14), and an output video data calculating section (16), wherein the average luminance calculating section (12) determines the average luminance level APL for n frame images from the input video data X (X>=0) on the X-Y coordinate system, the LUT (14) determines central value data Xc, Yc from the APL, and the output video data calculating section (16) determines the output video data Y (Y>=0) collected after the contrast is adjusted according to the calculation formula Y=A·X+Yc−A·Xc where A (A>0) is the slope variably set for contrast adjustment, whereby the rise of the luminance at a low level when A is increased and the contrast is heightened, is suppressed to adjust the contrast corresponding to the APL for frame images.

6 Claims, 4 Drawing Sheets

A is variable (A>1), APL is constant (APL1≦APL≦APLm)

A is variable (A<1), APL is constant (APL1≦APL≦APLm)

CONTRAST ADJUSTING CIRCUIT

TECHNICAL FIELD OF THE INVENTION

The present invention relates to a contrast adjusting circuit for displays such as a PDP, using the PDP (Plasma Display Panel) or the like.

BACKGROUND ART

Conventionally, this kind of contrast adjusting circuit is composed of a multiplying circuit 10 as is shown in FIG. 1, the multiplying circuit 10 being designed to obtain the output video data Y by multiplying the video data X by a variably set slope A.

When the input video data X and the output video data Y are represented by X (X>=0) and Y (Y>=0) of the X-Y coordinates, there holds a relationship, Y=A X, an expression representing a straight line A including the original (0, 0), between the input video data X and the output video data Y as shown in FIG. 2. That is, assuming that the variable ranges of the slope A to be from A1 to Am (A1=<A=<Am, m being an integer 2 or more), the contrast increases when the slope A is increased (e.g., Y=Am·X), whereas the contrast decreases when the slope A is decreased (e.g., Y=A1·X).

However, in the case of the prior art as is shown in FIG. 1 there occurs a problem such that, when the contrast is set to a high level by setting the slope A to a high level (e.g., A=Am), the luminance of the image corresponding to low-level input video data X (i.e., low input level) becomes too high causing the image to become whitish.

Another problem of the prior art has been that the optimal contrast adjustment cannot be made to the ever-changing conditions of the image.

The present invention is made in consideration of the problem of the prior art and is first intended to provide a contrast adjusting circuit capable of controlling the increase in low-level luminance at the time when the contrast is increased, thereby preventing the image from becoming whitish.

The second object of the present invention is to provide a contrast adjusting circuit capable of adjusting the contrast to an optimal level corresponding to the ever-changing conditions of the image.

DISCLOSURE OF THE INVENTION

The contrast adjusting circuit according to the present invention comprises a video data calculating section designed to obtain the output video data by substituting the input video data X, the slope A and the central point data Xc and Yc in the calculation formula, Y=A·X+Yc−A·Xc respectively, where X (X>=0) of the X-Y coordinate system is the input video data; Y (Y>=0) is the output video data with adjusted contrast; A (A>0) is the variably set contrast adjusting slope; Xc and Yc (Xc>0, Yc>0) are the central point data.

In such a system, the calculation formula Y=A·X+Yc−A·Xc to be applied to the operation of the video data calculating section produces a straight line passing through the points (Xc, Yc) within the first quadrant (Xc>0, Yc>0) not including the origin (0, 0) of the X-Y coordinates. Therefore, when the slope A, the slope for adjusting the contrast, is increased to increase the contrast, the rise of the output video data Y corresponding to the low level of the input video data X can be prevented, unlike the case of the prior art represented by the calculation formula, Y=A·X, which produces a slope passing through the origin (0, 0), thereby preventing the image from becoming whitish.

Differing from the invention described above, in order to enable the contrast to be adjusted according to the average luminance level of each image, there is also provided an average luminance calculating section for obtaining the average luminance level of the images during an n-frame period (n being an integer of 1 or more), and a data converting section for converting the average luminance level to the corresponding central point data, Xc and Yc, out of a plurality of predetermined central point data, so that the central point data, Xc and Yc, can be used as the central point data in the video data calculating section. In other words, since the output video data Y, corresponding to the average luminance level of the n frame images, can be obtained by the calculation formula, Y=A·X+Yc−A·Xc, the contrast can be adjusted according to the level of the average luminance of the image.

Differing from the invention described above, in order to simplify the composition of the video data calculating section, the video data calculation section comprises a subtracting circuit for subtracting the central point data Xc from the input video data X, a multiplying circuit for multiplying the output data of the subtracting circuit by the slope A, and an adding circuit for adding the central point data Yc to the output data of the multiplying circuit to thereby obtain the output video data Y.

Differing from the invention described above, the central point data, Xc and Yc, are given as data on the basis of Y=X, and the video data calculating section is designed to obtain the video data Y by using the calculation formula, Y=A X+Xc·(1−A), which is introduced by setting Yc=Xc in the calculation formula, Y=A·X+Yc−A·Xc. In this method, in all the cases where the slope A for the adjustment of the contrast is 1 or more, the rise of the luminance of the output video data Y at the low level of input video data X can be prevented. In other words, the line represented by Y=A·X+Xc·(1−A), which is introduced by setting Yc=Xc in the calculation formula, Y=A·X+Yc−A·Xc, passes through the point represented by Y=X, so that, when A is 1 or more, the value of Xk representing the X-coordinate value of intersection (Xk, 0) between the straight line X and the straight line Y becomes larger than 1, thereby not only enabling the Y-coordinate values, corresponding to X-coordinate values ranging from 0 to Xk to be made equal to 0 but also enabling the value of Y to be made smaller than that by the prior art, even when the value of X is larger than Xk.

Differing from the invention described above, in order to enable the contrast to be adjusted according to the level of the average luminance of each image, the average luminance calculating section for obtaining the average luminance level of the images during the n-frame period on the basis of the input video data X and the data converting sections for converting the average luminance level, which is obtained by the average luminance calculating section, to the corresponding central point data, Xc and Yc, out of a plurality of predetermined central point data, whereby the central point data, Xc and Yc, which are outputted from the data converting section, are processed by the video data calculating sections.

In other words, the central point data, Xc and Yc, which are to be processed by the video data calculating section, undergoes the contrast adjustment as being the data corresponding to the average luminance level of the n-frame images.

Differing from the invention described above, in order to simplify the composition of the video data calculating section, the video data calculating section comprises a first multiplying circuit for multiplying the input video data by the slope A, a subtracting circuit for subtracting the slope A from the constant 1, a second multiplying circuit for multiplying the output data of the subtracting circuit by the central point data Xc, and an adding circuit for adding the output data of the first multiplication circuit to the output data of the second multiplying circuit to thereby obtain the output video data Y.

Differing from the inventions described above, in order to simplify the composition of the data converting section, the data converting section comprises a look-up table which outputs the corresponding central point data, Xc and Yc, by using the average luminance, which is obtained by the average luminance calculating section, as the address.

Differing from the invention described above, in order to simplify the composition of the data converting section, the data converting section comprises a look-up table which is designed to output the corresponding central point data Xc by using as the address the average luminance obtained by the average luminance calculating section.

BEST MODE OF CARRYING OUT THE INVENTION

Figure 1:
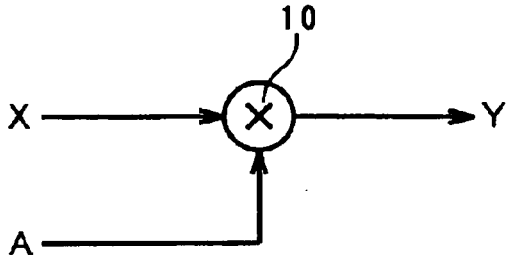
FIG. 1 (PRIOR ART)
FIG. 1 is a block diagram illustrating the prior art.
Figure 2:
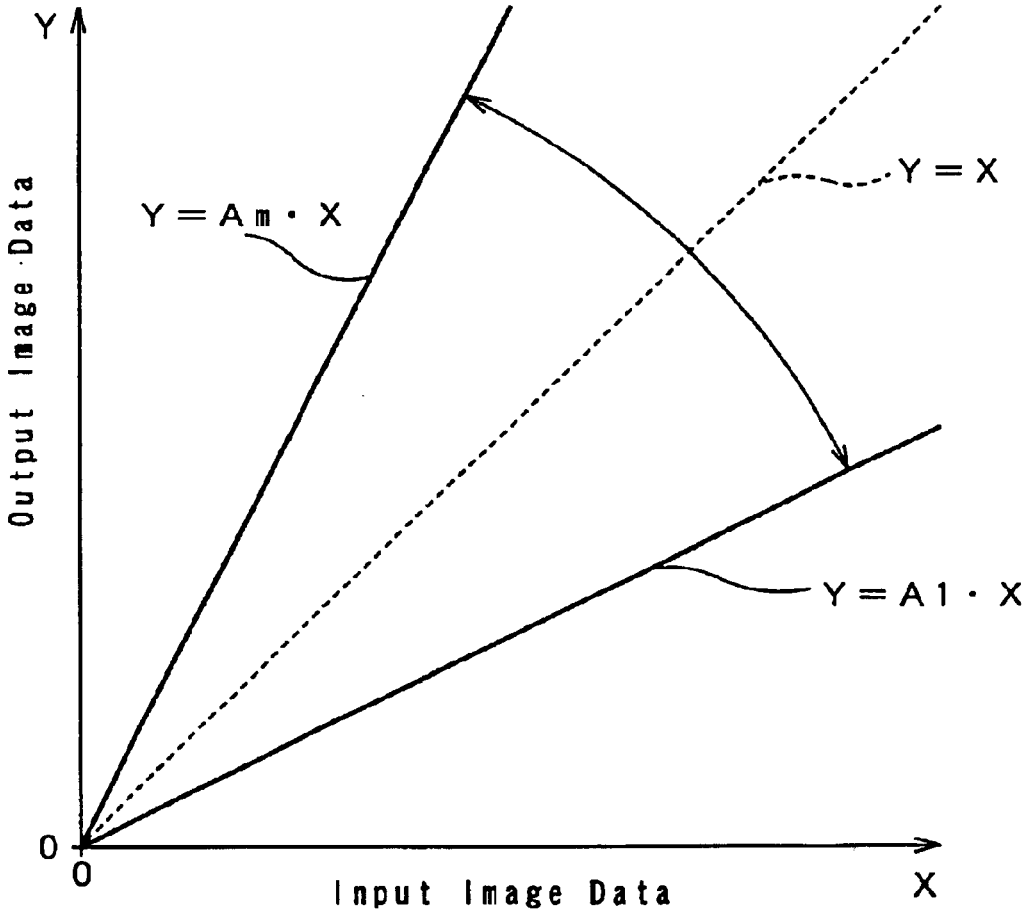
FIG. 2 (PRIOR ART)
FIG. 2 is a diagram illustrating the function of the system illustrated in FIG. 1, and is also an input/output characteristic diagram indicating the relationship between X and Y.

The embodiments of the present invention will be described referring to the drawing.

Figure 3:
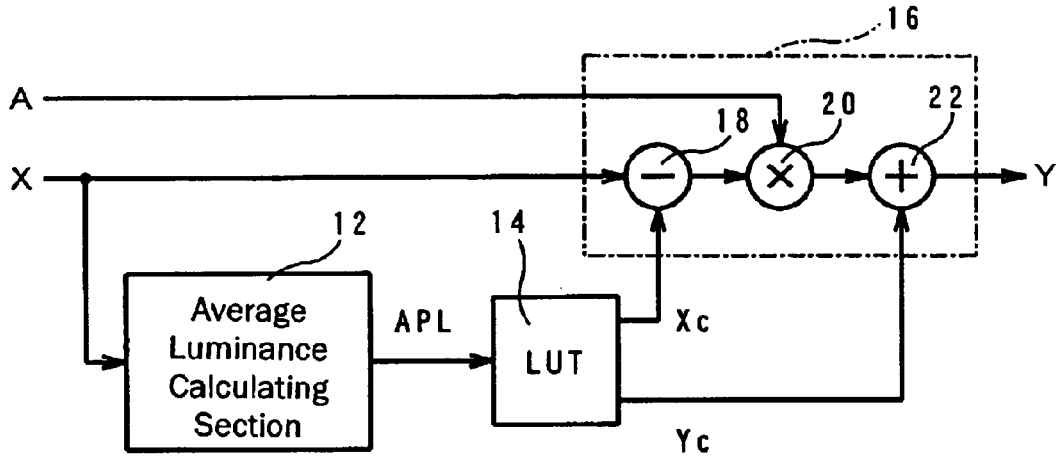
FIG. 3 is a block diagram illustrating the contrast adjusting circuit as the first embodiment of the present invention.

FIG. 3 shows a contrast adjusting circuit as the first embodiment of the present invention. In FIG. 3, reference numeral 12 represents the average luminance calculating section; 14, the LUT (Look Up Table) as an example of the data converting section; 16, the video data calculating section.

As described later, on the X-Y coordinates, the X (X>=0) is the input video data; the Y(Y>=0) is the output video data whose contrast has been adjusted; A (A>0) is a predetermined variable slope for the adjustment of the contrast.

The average luminance calculating section 12 determines the average picture level (hereinafter referred to as APL) of the images of an n-frame period (n being an integer larger than 1, e.g., n=1) on the basis of input video data X.

The LUT 14 outputs the corresponding central point data, Xc and Yc (Xc>0, Yc>0), out of a plurality of predetermined central point data on the coordinates Y=X.

The video data calculating section 16 substitutes the input video data X, the slope A and the central point data (Xc, Yc) in the calculation formula $Y=A\cdot X+Yc-A\cdot Xc$ to calculate the output video data Y.

The above video data calculating section 16 comprises a subtracting circuit 18 for subtracting the central point data Xc from the input video data X, a multiplying circuit 20 for multiplying the output data of the subtracting circuit 18 by the slope A, and an adding circuit 22 for adding the central point data Yc to the output data of the multiplying circuit 20 to generate the output video data Y.

Next, the function of the system illustrated in FIG. 3 will be described referring to FIGS. 4 through 7.

(1) When the input video data X is inputted to the average luminance calculating section 12, the average luminance calculating section 12 determines the APL of the images during an n-frame period (e.g., 1 frame period) on the basis of the input video data X.

(2) When the APL, obtained by the average luminance calculating section 12, is inputted to the LUT 14, the corresponding central point data Xc and Yc are outputted out of a plurality of predetermined central point data represented by the coordinates of Y=X by using the APL as the addresses.

(3) The video data calculating section 16 obtains the output video data Y by substituting the central point data, Xc and Yc, outputted from the LUT 14, in the calculation formula, $Y=A\cdot X+Yc-A\cdot Xc$, for each pixel (e.g., for each dot) during an n-frame period, by using the input video data X, the set slope A and the APL of the immediately preceding n-frame image as addresses.

In other words, Xc is subtracted from X in the subtracting circuit 18; the output data from the subtracting circuit 18 is multiplied by A in the multiplying circuit 20; Yc is added to the output data $A\cdot(X-Xc)$ of the multiplying circuit 20 in the adding circuit 22; the obtained data $\{A\cdot(X-Xc)+Yc\}$ represents Y.

Figure 4:
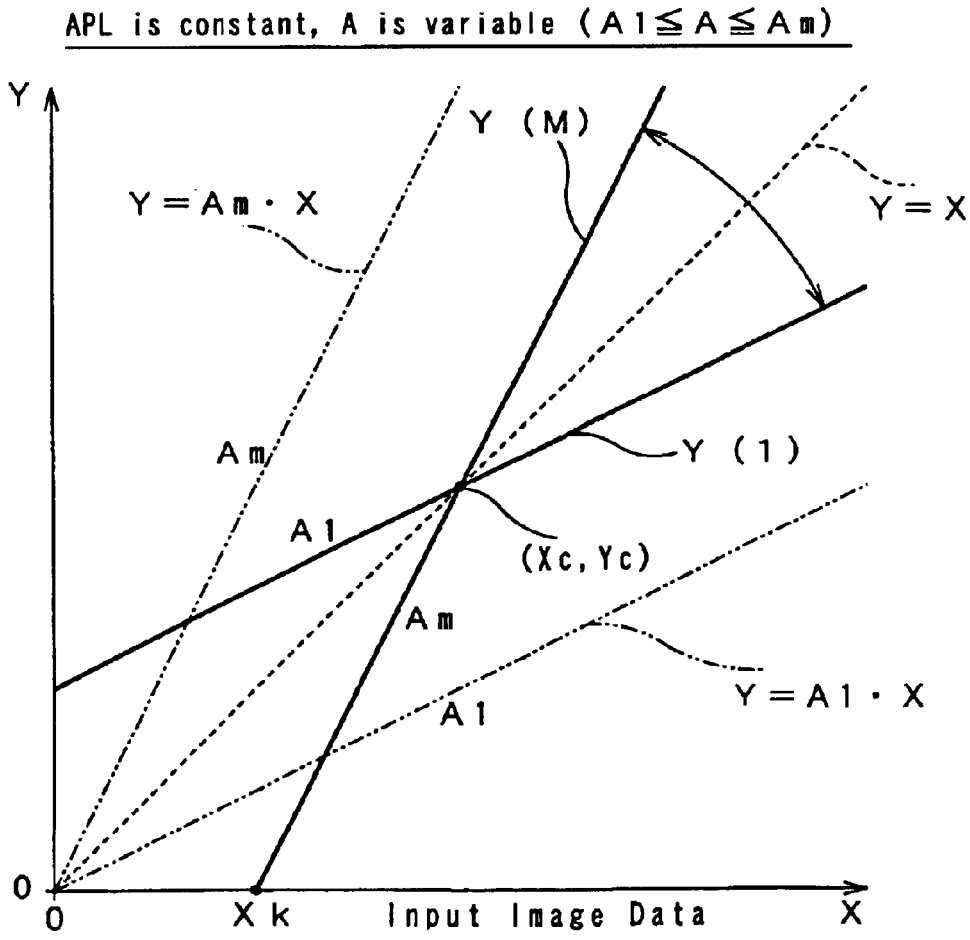
FIG. 4 is a characteristic diagram illustrating the function of the system illustrating in FIG. 3, and is also an input/output characteristic diagram illustrating the relationship of X and Y where the central point data Xc and Yc are the coordinates of Y=X; APL is constant; and A is variable.

(4) When the slope A is varied for an image whose APL is constant, e.g., when the user varied A within the range of A1 to Am by varying the resistance value for contrast adjustment, the contrast can be adjusted along the straight line, Y(1)–Y(M) within the range indicated by the arrows in FIG. 4.

(4-1) When A is set larger than 1 (e.g., A=Am) to raise the contrast, the relationship between X and Y, for instance, becomes like Y(M) in FIG. 4. Y(M) represents the straight line, $Y(M)=Am\cdot X+Yc-Am\cdot Xc$, which is obtained by substituting Am for the A in $Y=A\cdot X+Yc-A\cdot Xc$. Therefore, regardless of the values of the central point data, Xc and Yc, in the first quadrant of the X-Y coordinate system where Y=X, the Xk of the intersection (Xk, 0) between the straight line Y(M) and the X-axis, becomes larger than 0 as shown in FIG. 4; when the X ranges from 0 to Xk, Y can be set to 0; even when X is larger than Xk, the value of Y can be set smaller than that in the case of the prior art (Y=Am·X).

In consequence, not only the rise of the luminance of the lower level at the time when the contrast is raised thereby to prevent the image from becoming whitish but also the contrast can be adjusted corresponding to the APL of each image.

(4-2) When A is set smaller than 1 (e.g., A=A1), the relationship between X and Y becomes, for instance, as Y(1) in FIG. 4. This Y(1) represents the straight line Y(1)=A1·X+Yc−A1·Xc, wherein A1 is substituted for A in Y=A·X+Yc−A·Xc.

Figure 5:
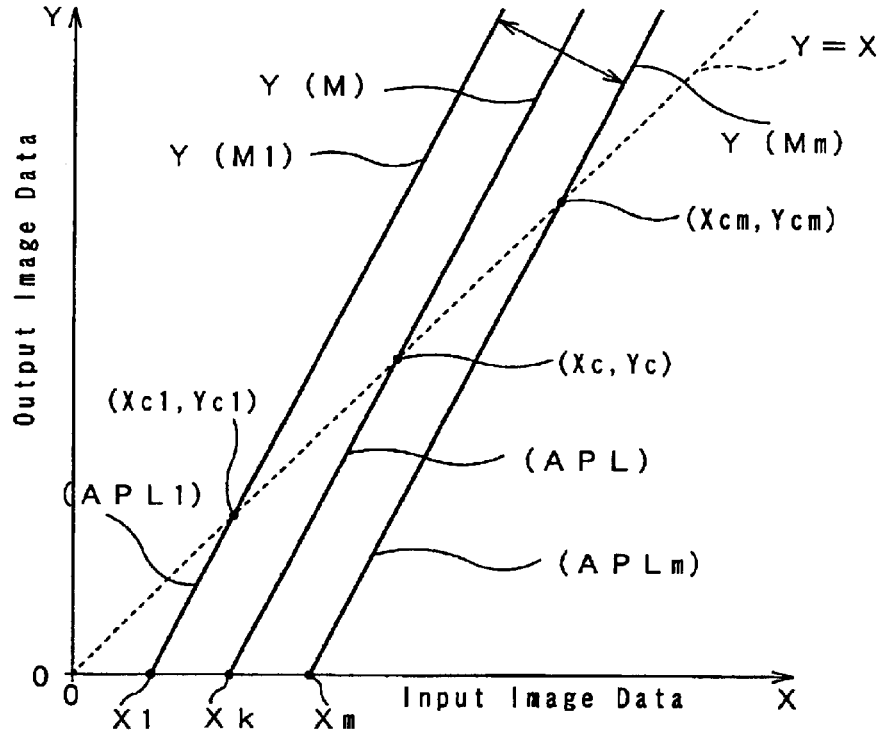
FIG. 5 is a characteristic diagram illustrating the function of the system illustrated in FIG. 3 and is also an input/output characteristic diagram illustrating the relationship between X and Y where the central point data (Xc, Yc), (Xcl, Ycl) and (Xcm, Ycm) are on the coordinates of Y=X; A, which is larger than 1, is constant; and the relationship between X and Y where the APL is variable.

(5) When, after raising the contrast by setting A larger than 1 (e.g., A=Am), A is set constant, and the APL is made to vary within the range where the APL is APL1 or more but APLm or less, the contrast is adjusted along the straight lines, Y(M1)−Y(Mm), within the range indicated by arrows in FIG. 5.

(5-1) When the level of the APL is relatively high (e.g., APL−APLm), the relation between X and Y becomes Y(Mm) as is shown in FIG. 5. This Y(Mm) represents a straight line, Y(Mm)=Am·X+Ycm−Am·Xcm, where Am is substituted for, and Xcm and Ycm are substituted for Xc and Yc in Y=A·X+Yc−A·Xc. In this case, Xcm and Ycm represent the data outputted from the LUT14 by using the APLm as an address.

(5-2) Where the value of the APL is relatively small (e.g., APL=APL1), the relationship between X and Y becomes Y(M1) in FIG. 5. This Y(M1) represents a straight line, Y(M1)=Am·X+Ycl−Am·Xcl introduced by substituting Am for A, while substituting Xcl and Ycl for Xc and Yc, in Y=A·X+Yc−A·Xc. In this case, Xcl and Ycl represent the data outputted from the LUT 14 by using the APL1 as the address.

(5-3) Therefore, as shown in FIG. 5, the values, X1, Xk and Xm of the intersections, (X1,0), (Xk,0), (Xm,0) of the straight lines, Y(M1), Y(M) and Y(Mm) to the X-axis are respectively larger than 0, so that, where the value of X is within the range of 0, X1, Xk and Xm, the value of Y can be set to 0 where the value of X is within 0, X1, Xk and Xm, and the value of Y can be made smaller than that in the case of the prior art, even when the value of X is X1 or more, Xk or more and Xm or more.

In consequence, not only the rise of the luminance for a lower level at the time when the contrast is raised can be prevented to prevent the image from becoming whitish but also the contrast of each image can be adjusted according to the APL of each image.

Figure 6:
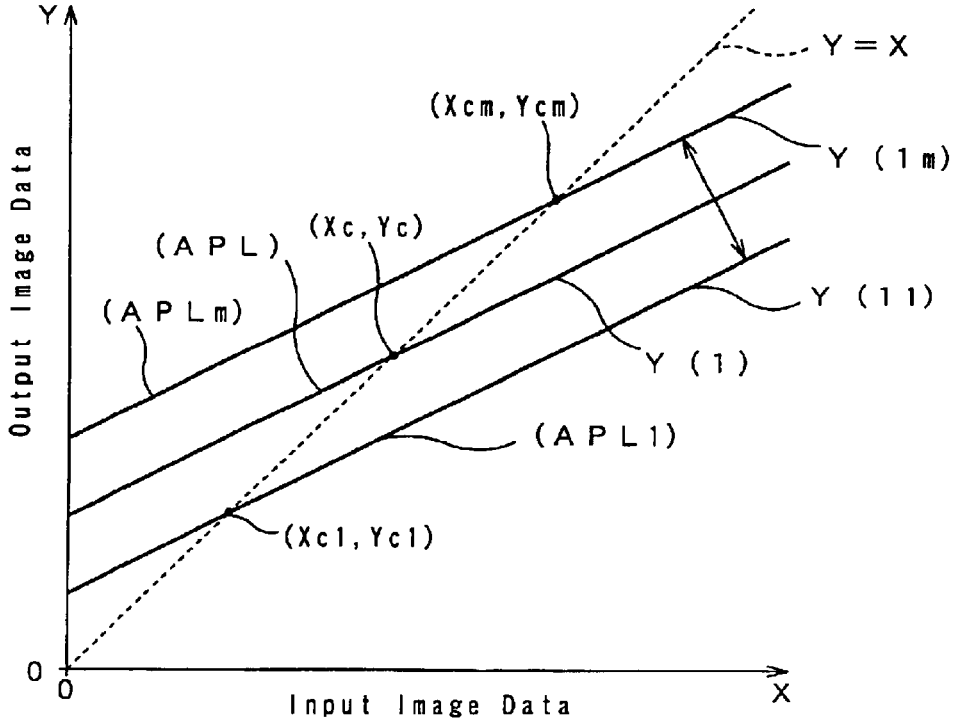
FIG. 6 is a characteristic diagram illustrating the function of the system shown in FIG. 3, and is also an input/output characteristic diagram indicating that the central point data (Xc, Yc), (Xcl, Ycl) and (Xcm, Ycm) are represented by coordinates of Y=X, and that A which is smaller than 1 is constant, while the APL is variable.

(6) Further, when, after setting A smaller than 1 (e.g., A=A1) to lower the contrast, and when A is constant, and when the APL is varied within a range, which is APL1 or more and APLm or less, the contrast is adjusted within the range indicated by the arrows and along the straight lines, Y(11) through Y(1m) in FIG. 6.

(6-1) When the value of APL is relatively high (e.g., APL=APLm), the relationship of X and Y becomes Y(1m) as shown in FIG. 6. This Y(1m) represents the straight line Y(1m)=A1·X+Ycm−A1·Xcm introduced by substituting A1 for A, and Xcm and Ycm for Xc and Yc in Y=A·X+Yc−A·Xc.

(6-2) When the APL is relatively small (e.g., APL=APL1), the relationship of X and the Y becomes as represented by Y(11) in FIG. 6. This Y(11) represents a straight line Y(11)=A1·X+Ycl=A1·Xcl, introduced by substituting A1 for A and Xcl and Ycl for Xc and Yc in Y=A·X+Yc−A·Xc.

(6-3) Thus, it is possible to adjust the contrast according to the APL of each image.

Figure 7:
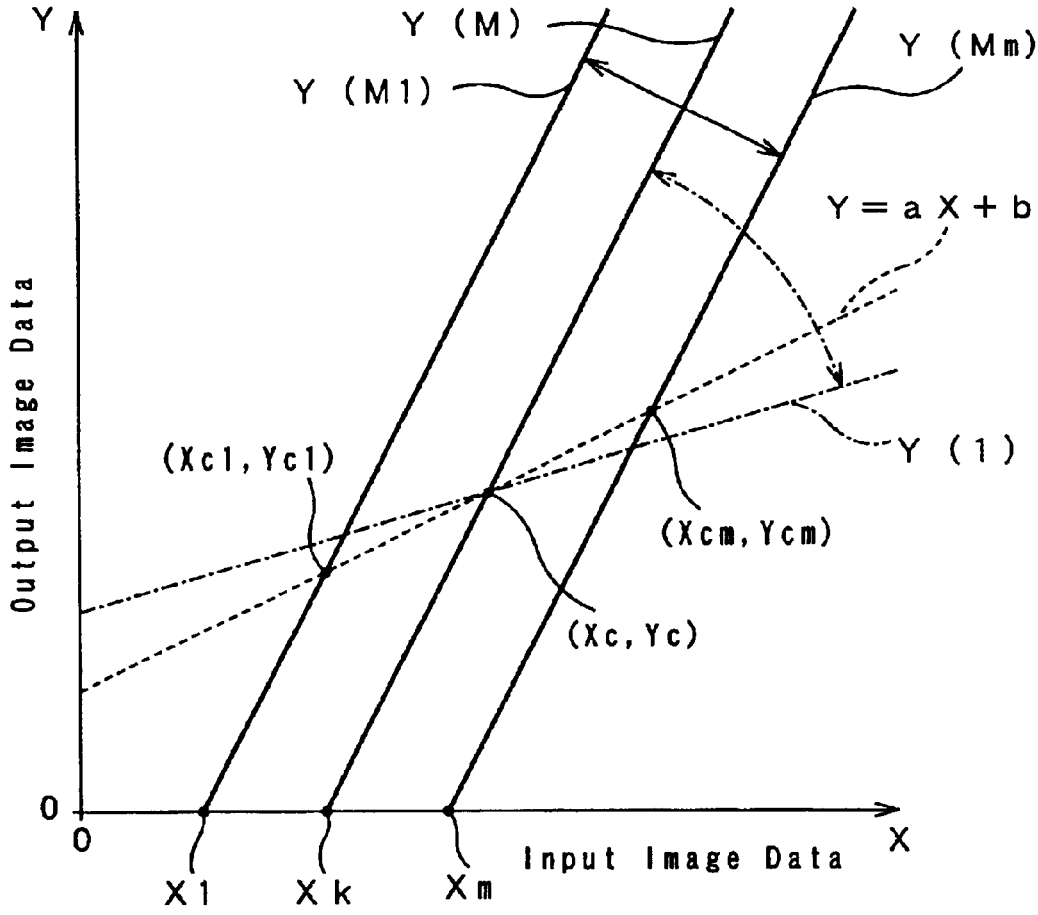
FIG. 7 is a characteristic diagram illustrating the function of the system shown in FIG. 3, and is also an input/output characteristic diagram showing the case where the central point data (Xc, Yc), (Xcl, Ycl) and (Xcm, Ycm) are represented by Y=aX+b where APL is constant while A is variable, and the case where the central point data, (Xc, Yc), (Xcl, Ycl) and (Xcm, Ycm) are represented by Y=aX+b where A is a constant value larger than 1 while APL is variable.

In the embodiment of the present invention shown in FIG. 3, the system is designed so that the central point data, Xc and Yc, outputted from the LUT 14 correspond to the values represented by Y=X (i.e., Yc=Xc) by using the APL as the address, but the present invention is not limited to this embodiment. For instance, as shown in FIG. 7, the present invention is also applicable to the case where the system is designed so that the central point data, Xc and Yc, outputted from the LUT 14 by using the APL as the address, are set as being the values represented by Y=a·X+b (i.e., Yc=a·Xc+b). In this case, a and b represent the properly set constants respectively.

For instance, when the APL is kept constant while A is varied, as shown in FIG. 7, the contrast is adjusted within the range indicated by the arrows followed by a dot-and-dash line and along the straight line, Y(1) through the straight line Y(M).

Therefore, when A is increased to 1 or more (e.g., A=Am) to raise the contrast, the relationship between X and Y is represented by the solid line Y(M) in FIG. 7. Even when the central point data, Xc and Yc, are represented by Y=aX+b, the value of the intersection Xk (Xk, 0) between the straight line Y(M) and X-axis becomes larger than 0 within the range of A>1. That is, similarly to the case shown in FIG. 4, where X ranges from 0 to Xk, Y can be set to 0, and further even where X is Xk or more, the value of Y can be made smaller than that in the case of the prior art.

Therefore, not only the rise of the luminance at low levels at the time when the contrast is raised can be prevented, thereby preventing the image from becoming whitish but also the contrast can be adjusted according to the APL of each image.

Further, when A is set as a constant value larger than 1 (e.g., A=Am) while letting the APL vary (APL1=<APL=<APLm), the contrast can be adjusted, for instance, along the straight lines, Y(M1), Y(M) and Y(Mm), based on the central point data, (Xcl, Ycl), (Xc, Yc) and (Xcm, Ycm) which are represented by Y=a·X+b.

Thus, when the APL is given as APL1, APLk or APLm, the relationship between X and Y are represented by Y(M1), Y(M) and Y(Mm) shown in FIG. 7, and, even when the central point data, (Xcl, Ycl), (Xc, Yc), (Xcm, Ycm) are represented by Y=aX+b, the values, X1, Xk and Xm at the intersections, (X1, 0), (Xk, 0), (Xm, 0), of the straight lines, Y(M1), Y(M) and Y(Mm), and the X-axis, become larger than 0. In other words, similarly to the case shown in FIG. 5, where the value of X is given as 0, X1, Xk or Xm, Y can be made 0; even when the value of X is larger than X1, Xk or Xm, the value of Y can be made smaller than that in the case of the prior art.

In consequence, even if the contrast is raised, the rise of the luminance at a low level can be prevented, thereby not only preventing the image from becoming whitish but also enabling the contrast to be adjusted according to the APL of each image.

Figure 8:
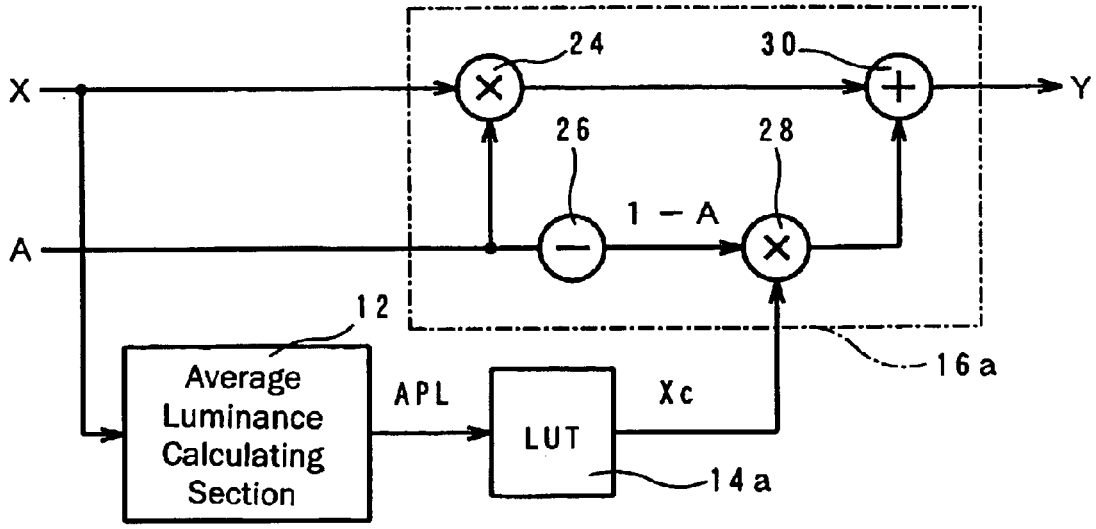
FIG. 8 is a block diagram showing the contrast adjusting circuit as the second embodiment of the present invention.

FIG. 8 shows a contrast adjusting circuit as a second embodiment of the present invention, which is made available by replacing the LUT 14 and the video data calculating section 16 of the first embodiment with the LUT 14*a* and the video data calculating section 16*a*, which will be described later.

In FIG. 8, the descriptions of those reference numerals similar to those in FIG. 3 will be omitted as being those for similar parts.

In FIG. 8, 14*a* represents the LUT as an example of a data converting section, and 16*a* represents an image data calculating section.

The LUT 14*a* outputs a corresponding central point data Xc, out of a plurality of predetermined central point data represented by the X-Y coordinate system for Y X, by using, as the address, the APL determined by the average luminance calculating section 12.

The video data calculation section 16*a* calculates the output video data Y by substituting the input video data X, slope A and central point data X in the calculation formula, $Y=A\cdot X+Xc\ (1-A)$. This video data calculating section 16*a* performs the calculation, which is equivalent to the calculation by the calculation formula $Y=A\cdot X+Yc-A\cdot Xc$ where $Yc=Xc$.

More specifically, the video data calculating section 16*a* comprises a first multiplying circuit 24 for multiplying the input video data X by the slope A, a subtracting circuit 26 for subtracting the slope A from constant 1, a second multiplying circuit 28 for multiplying the output data of the subtracting circuit 26 by the central point data Xc, and an adding circuit 30 for adding the output data of the first multiplying circuit 24 and the output data of the second multiplying circuit 28 to produce the output video data Y.

Next, the function of the system illustrated in FIG. 8 will be described referring to FIGS. 4 through 6.

(1) Upon input of the video data X to the average luminance calculating section 12, the APL of the image for an n-frame period (e.g., 1 frame period) is obtained by the average luminance calculating section 12 on the basis of the input video data X.

(2) Upon input of the APL, obtained by the average luminance calculating section 12, to the LUT 14*a*, the corresponding central point data Xc, out of a plurality of predetermined central point data represented by the X-Y coordinate system for Y=X, is outputted from the LUT 14*a*.

(3) During the n-frame period, the video data calculating section 16*a* obtains the output video data Y for each pixel (e.g., for each dot) by substituting the input video data X, set slope A and the central point data Xc outputted from the LUT 14*a*, in the calculation formula, $Y=A\cdot X+Xc\cdot(1-A)$ by using, as an address, the APL of the immediately preceding n-frame image.

In other words, X is multiplied by the slope A in the first multiplying circuit 24; A is subtracted from the constant 1 in the subtracting circuit; the output data (1−A) of the subtracting circuit 26 is multiplied by Xc in the second multiplying circuit; the output data $\{Xc\cdot(1-A)\}$ of the second multiplying circuit 28 is added to the output data $A\cdot X$ of the first multiplying circuit 24 by the adding circuit 30, and the obtained data, $\{A\cdot X+Xc\cdot(1-A)\}$ is treated as Y.

(4) In the case of an image whose APL is constant, when the slope A is varied, similarly to the case of the embodiment given in FIG. 3, the contrast is adjusted within the range indicated by the arrows and along the straight lines Y(1) through Y(M).

In other words, when the contrast is raised by increasing the value of A, which is variable within A1 and Am, the relationship between X and Y is represented, for example, by Y(M) in FIG. 4, whereby the luminance at low levels can be prevented from rising to prevent the image from becoming whitish, while enabling the contrast to be adjusted matching with the APL of each image.

(5) When A is set larger than 1 (e.g., A=Am) and constant, while setting the APL (APL1=<APL=<APLm) variable, the contrast can be adjusted within the range indicated by the arrows and along the straight lines Y(M1) through Y(Mm) as shown in FIG. 5. In other words, the relationship between X and Y becomes as represented by Y(Mm) in FIG. 5 when the value of the APL is relatively large, and it becomes as represented Y(M1) in the same figure when the value of APL is relatively small. Therefore, when the contrast is raised, not only can the rise of the luminance at low levels be prevented to prevent the image from becoming whitish but also the contrast can be adjusted, matching with the APL of each image.

(6) When A is set smaller than 1 (e.g., A=A1) and constant, while the APL (APL1=<APL=<APLm) is set variable, the contrast is adjusted within the range indicated with the arrows and along the straight lines Y(11) through Y(1m) as in FIG. 6.

In other words, the relationship between X and Y becomes like Y(1m) in FIG. 6 when the value of the APL is relatively large, while the same becomes like Y(11) in the same figure when the APL is relatively small, thereby enabling the contrast to be adjusted, matching with the APL of each image.

In each of the embodiments shown in FIG. 3 and FIG. 8, the data converting section is composed of the LUT in order to simplify the composition of the data converting section. The present invention, however, is not limited to these embodiments, and thus the data converting section may be any one capable of converting the average luminance, obtained by the average luminance calculating section, to Xc and Yc (Xc>0, Yc>0) out of a plurality of predetermined central point data represented by the X-Y coordinate system, or any one capable of converting the average luminance, obtained by the average luminance calculating section, to the corresponding central point data Xc (Xc>0) out of a plurality of predetermined central point data represented by the X-Y coordinate system.

In those previously described embodiments shown in FIG. 3 and FIG. 8, in order for the contrast to be adjusted according to the average luminance level of each image, there are provided the average luminance calculating section, designed to obtain the average luminance level of the images during the n-frame period based on the input video data X, and the data converting section, designed to convert the average luminance level to corresponding central point data Xc, Yc or Xc out of a plurality of predetermined central point data. The present invention, however, is not limited to these embodiments. That is, the present invention is also applicable to the case where the average luminance calculating section and the data converting section are omitted so that the central point data, Xc, Yc or Xc to be used in the video data calculating section is set separately just like the case of the slope A.

INDUSTRIAL APPLICABILITY

As discussed in the foregoing, the contrast adjusting circuit according to the present invention is designed so that the rise of the luminance at low levels is prevented to prevent the image from becoming whitish when the contrast is raised. The present invention is also applicable for making optimal adjustment of the contrast, coping with ever-changing conditions of the image.

What is claimed is:

1. A contrast adjusting circuit comprising a video data calculating section comprising a subtraction circuit for subtracting central point data Xc from input video data X, a multiplying circuit for multiplying output data from the subtraction circuit by a slope A and an adding circuit for adding central point data Yc to output data from the multiplying circuit to obtain output video data, designed for obtaining output video data Y by substituting the input video data X, the slope A and the central point data Xc and Yc in a calculation formula, Y=A·X+Yc−A−Xc, where the input video data is given as X, X_>=_0; the output video data after contrast adjustment as Y, Y_>=_0; the slope variably set for contrast adjustment as A, A_>_0; the central point data as Xc and Yc, Xc_>_0 and Yc_>_0, an average luminance calculating section for obtaining the average luminance level of an image during an n-frame period, n being an integer of 1 or more, and a data converting section comprising a look-up table that outputs the corresponding central point data, Xc and Yc, by using the average luminance, obtained by the average luminance calculating section, as an address, for converting the average luminance level obtained by the average luminance calculating section to the corresponding central point data, out of a plurality of predetermined central point data, wherein the central point data Xc and Yc to be outputted from the data converting section are used as the central point data to be inputted to the video data calculating section.

2. A contrast adjusting circuit comprising a video data calculating section designed for obtaining output video data Y by substituting input video data X, slope A and central point data Xc and Yc in a calculation formula, Y=A·X+Yc−A·Xc, where the input video data is given as X, X_>=_0; the output video data after contrast adjustment as Y, Y_>=_0; the slope variably set for contrast adjustment as A, A_>_0; the central point data as Xc and Yc, Xc_>_0 and Yc_>_0, wherein the video data calculation section is designed to obtain the output video data Y by a calculation formula Y=A·X+Xc·(1−A), which is introduced from the calculation formula Y=A·X+Yc−A·Xc by setting Yc=Xc.

3. The contrast adjusting circuit according to claim 2, comprising an average luminance calculating section for obtaining the average luminance level of an image during an n-frame period, n being an integer of 1 or more, based on the input video data X and a data converting section for converting the average luminance level, obtained by the average luminance level calculating section, to corresponding central point data Xc and Yc out of a plurality of predetermined central point data so that the central point data, outputted from the data converting section, is used as the central point data to be processed by the video data calculating section.

4. The contrast adjusting circuit according to claim 3, wherein the video data calculating section comprises a first multiplication circuit for multiplying the input video data X by the slope A, a subtracting circuit for subtracting the slope A from the constant 1, a second multiplication circuit for multiplying the output data of the subtracting circuit by the central point data Xc and an adding circuit for adding the output data of the first multiplication circuit to the output data of the second multiplication circuit to thereby obtain the output video data.

5. The contrast adjusting circuit according to claim 3, wherein the data converting section comprises a look-up table for outputting corresponding central point data by using the average luminance obtained by the average luminance calculating section as an address.

6. The contrast adjusting circuit according to claim 4, wherein the data converting section comprises a look-up table for outputting corresponding central point data Xc by using the average luminance obtained by the average luminance calculating section as an address.

* * * * *